US011174702B2

(12) United States Patent
Quilico et al.

(10) Patent No.: US 11,174,702 B2
(45) Date of Patent: Nov. 16, 2021

(54) DUAL FLAPPER ISOLATION VALVE

(71) Applicant: SCHLUMBERGER TECHNOLOGY CORPORATION, Sugar Land, TX (US)

(72) Inventors: Marco Quilico, Pearland, TX (US); Jason Henry, Houston, TX (US); Ignacio Marquez, Houston, TX (US); Garis McCutcheon, Missouri City, TX (US); Geoffrey Pinard, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/639,288

(22) PCT Filed: Aug. 15, 2018

(86) PCT No.: PCT/US2018/000149
§ 371 (c)(1),
(2) Date: Feb. 14, 2020

(87) PCT Pub. No.: WO2019/035885
PCT Pub. Date: Feb. 21, 2019

(65) Prior Publication Data

US 2020/0256155 A1 Aug. 13, 2020

Related U.S. Application Data

(60) Provisional application No. 62/545,844, filed on Aug. 15, 2017.

(51) Int. Cl.
*E21B 34/08* (2006.01)
*E21B 34/12* (2006.01)

(52) U.S. Cl.
CPC ..... *E21B 34/08* (2013.01); *E21B 34/12* (2013.01); *E21B 2200/05* (2020.05)

(58) Field of Classification Search
CPC ..... E21B 34/08; E21B 34/10; E21B 34/12; E21B 34/101; E21B 2200/05
See application file for complete search history.

(56) References Cited

U.S. PATENT DOCUMENTS 2,952,438 A * 9/1960 Conrad ..... E21B 34/12 251/348
3,036,810 A * 5/1962 Conrad ..... E21B 34/12 251/95

(Continued)

OTHER PUBLICATIONS

International Search Report and Written Opinion issued in the related PCT Application PCT/2018/000149, dated Dec. 7, 2018 (10 pages).

(Continued)

*Primary Examiner* — David Carroll

(57) ABSTRACT

A downhole tool includes an upper flow tube connected to a lower flow tube, an upper flapper sub-assembly including an upper flapper, and a lower flapper sub-assembly including a lower flapper. The upper and lower flapper sub-assemblies are installed with respect to the upper and lower flow tubes in an "O" configuration such that the upper and lower flapper sub-assemblies are in a closed position. The upper and lower flapper sub-assemblies are capable of being independently actuated. The upper and lower flow tubes remain stationary when the upper flapper sub-assembly or the lower flapper sub-assembly is actuated from the closed position to an open position.

32 Claims, 7 Drawing Sheets

(56) References Cited

U.S. PATENT DOCUMENTS

| | | | | |
|---|---|---|---|---|
| 3,151,839 | A * | 10/1964 | Mott | E21B 34/12 251/351 |
| 5,857,523 | A * | 1/1999 | Edwards | E21B 34/066 166/374 |
| 2006/0162939 | A1 | 7/2006 | Vick et al. | |
| 2010/0230109 | A1 | 9/2010 | Lake et al. | |
| 2011/0088907 | A1 | 4/2011 | Xu | |
| 2011/0155381 | A1 | 6/2011 | Reaux | |
| 2013/0014958 | A1 | 1/2013 | Jani | |
| 2015/0068763 | A1* | 3/2015 | Jepp | E21B 41/00 166/373 |

OTHER PUBLICATIONS

International Preliminary Report on Patentability issued in the related PCT Application PCT/2018/000149, dated Feb. 27, 2020 (8 pages).

* cited by examiner

DUAL FLAPPER ISOLATION VALVE

CROSS-REFERENCE TO RELATED APPLICATION

This application claims priority to U.S. Provisional patent application having Ser. No. 62/545,844 which was filed on Aug. 15, 2017. The content of this priority application is incorporated herein by reference in its entirety.

BACKGROUND

This section provides background information to facilitate a better understanding of the various aspects of the disclosure. It should be understood that the statements in this section of this document are to be read in this light, and not as admissions of prior art.

The present disclosure relates generally to wellbore operations and equipment and more specifically to actuation devices for downhole tools (e.g., subsurface tools, wellbore tools) and methods of operation.

Hydrocarbon fluids such as oil and natural gas are produced from subterranean geologic formations, referred to as reservoirs, by drilling wells that penetrate the hydrocarbon-bearing formations. Once a wellbore is drilled, various forms of well completion components may be installed in order to control and enhance the efficiency of producing fluids from the reservoir and/or injecting fluid into the reservoir and/or other geological formations penetrated by the wellbore. In some wells, for example, valves are actuated between open and closed states to compensate or balance fluid flow across multiple zones in the wellbore. In other wells, an isolation valve may be actuated to a closed position to shut in or suspend a well for a period of time and then opened when desired. Often a well will include a subsurface valve to prevent or limit the flow of fluids in an undesired direction.

SUMMARY

According to one or more embodiments of the present disclosure, a downhole tool includes an upper flow tube connected to a lower flow tube, an upper flapper sub-assembly including an upper flapper, and a lower flapper sub-assembly including a lower flapper. In one or more embodiments, the upper flapper sub-assembly and the lower flapper sub-assembly are installed with respect to the upper flow tube and the lower flow tube in an "O" configuration such that the upper flapper sub-assembly and the lower flapper sub-assembly are in a closed position, the upper flapper sub-assembly and the lower flapper sub-assembly are capable of being independently actuated, and the upper flow tube and the lower flow tube remain stationary when the upper flapper sub-assembly or the lower flapper sub-assembly is actuated from the closed position to an open position.

According to one or more embodiments of the present disclosure, a method of operating a downhole tool includes installing an upper flapper sub-assembly comprising an upper flapper and a lower flapper sub-assembly comprising a lower flapper with respect to an upper flow tube and a lower flow tube in an "O" configuration such that the upper flapper sub-assembly and the lower flapper sub-assembly are in a closed position, independently actuating the upper flapper sub-assembly from the closed position to an open position, and independently actuating the lower flapper sub-assembly from the closed position to the open position. In one or more embodiments, the upper flapper sub-assembly includes an upper locking mechanism that engages the upper flow tube, the lower flapper sub-assembly includes a lower locking mechanism that engages the lower flow tube, and the upper flow tube and the lower flow tube remain stationary when the upper flapper sub-assembly or the lower flapper sub-assembly is actuated from the closed position to the open position.

According to one or more embodiments of the present disclosure, a downhole tool includes a flow tube, an upper flapper sub-assembly including an upper flapper, and a lower flapper sub-assembly including a lower flapper. In one or more embodiments, the upper flapper sub-assembly and the lower flapper sub-assembly are installed with respect to the flow tube in an "O" configuration such that the upper flapper sub-assembly and the lower flapper sub-assembly are in a closed position, the upper flapper sub-assembly and the lower flapper sub-assembly are capable of being actuated from the closed position to an open position by a single actuation mechanism, and after the upper flapper sub-assembly is actuated from the closed position to the open position, the flow tube travels downward to engage the lower flapper and open the lower flapper sub-assembly.

According to one or more embodiments of the present disclosure, a method of operating a downhole tool includes installing an upper flapper sub-assembly comprising an upper flapper and a lower flapper sub-assembly comprising a lower flapper with respect to a flow tube in an "O" configuration such that the upper flapper sub-assembly and the lower flapper sub-assembly are in a closed position, actuating the upper flapper sub-assembly from the closed position to an open position by an actuation mechanism, and after the actuating the upper flapper sub-assembly step, opening the lower flapper sub-assembly by the flow tube travelling downward to engage the lower flapper.

This summary is provided to introduce one or more embodiments, which are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
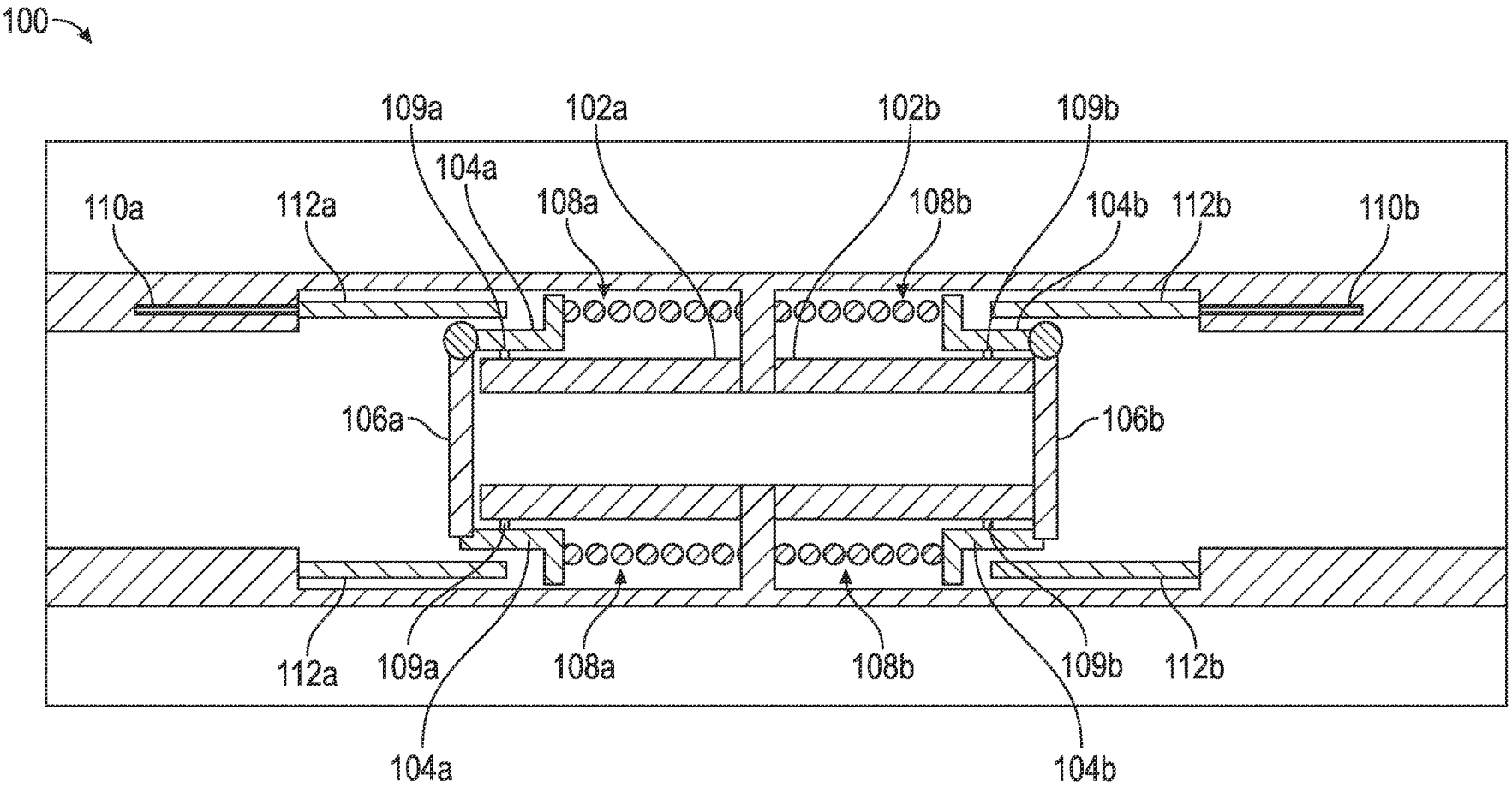
FIG. 1 is a schematic illustration of a dual flapper isolation valve having a fixed flow tube in a closed position according to one or more embodiments of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purposes of simplicity and clarity and does not in itself dictate a relationship between the various embodiments and/or configurations discussed.

As used herein, the terms "connect," "connection," "connected," "in connection with," and "connecting" may be used to mean in direct connection with or in connection with via one or more elements. Similarly, the terms "couple," "coupling," "coupled," "coupled together," and "coupled with" may be used to mean directly coupled together or coupled together via one or more elements. Further, the terms "engage" and "disengage" may be used to mean directly engaged or disengaged or engaged or disengaged via one or more elements. Terms such as "up," "upper," "above," "down," "downward," "lower," "below," "top," "bottom," and other like terms indicating relative positions to a given point or element may be utilized to more clearly describe some elements. Commonly, these terms relate to a reference point such as the surface from which drilling operations are initiated.

In a non-limiting embodiment, the downhole tool is a subsurface flow control device or valve in which the tool actuator engages and opens a valve closure member (e.g., flapper, ball, sleeve, etc.). In another embodiment, the tool actuator can progressively operate a variable choke member. The tool actuator includes, without limitation, devices that are known in the art and commonly referred to as flow tubes and sleeves. The closure member may include various devices such as, and without limitation to, flappers, ball valves, and sleeves. The term piston is utilized in the disclosure to refer to a device that is moved in response to a control signal to actuate a downhole tool. The signal may be, for example, an electric, mechanical, and/or fluidic signal urging the piston to move at least in a first direction. The piston and the control signal (e.g., driving force) may include, without limitation, a fluidic piston, an electric solenoid, a gear device, and combinations thereof.

Subsurface valves are commonly actuated to a first position (e.g., open) by the application of hydraulic pressure, for example from the surface, and biased to the second position (e.g., closed) by a biasing mechanism (stored energy assembly), such as an enclosed pressurized fluid chamber or a mechanical spring. The fluidic pressure may be applied to a piston and cylinder assembly, for example, that acts against the biasing force of the biasing mechanism to open and hold the valve opened. The biasing force acts on the piston to move it to a position allowing the closure member to move to the closed position when the actuating fluid pressure is reduced below a certain value.

Embodiments of the present disclosure include solutions for batch well drilling, completions, plugging, and suspension of wells. When an operator desires to install a lower and upper barrier in the completion prior to suspension, this tool may serve as the upper barrier. The geometry of the tool will allow for full bore access of large bore completions. In some embodiments, the tool may be installed between the tubing hanger and the safety valve in the completion. In other embodiments, the tool may be used for drilling applications, and may be used in different locations within the completion string. As well as performing as a wellbore barrier, upon installation, this tool may also serve as a solid bottom to pressure test a vertical Christmas tree once the well is ready for production.

A conventional Sub-Surface Safety Valve (SV) uses a single flapper system to control pressure from below. Over the years, Applicants have developed several flapper designs to provide a desired OD to ID ratio. Additionally, the TIVF™ product, which is used to set packers, includes operating principles, which may be implemented according to one or more embodiments of the disclosure.

In some embodiments, a bi-directional pressure barrier is provided, which will hold fluid-tight (e.g., gas or liquid tight) from uphole (to test wellhead) and downhole (to isolate well for suspension). Embodiments package two opposite facing flappers used in Sub-Surface Safety Valve products to create a bidirectional barrier in close proximity to the wellhead.

The use of flappers instead of ball valves provides a very low OD/ID ratio—this low ratio will provide the operator with a much larger bore access than any ball valve could achieve, thus providing enhanced hydrocarbon recovery and service tool access, while maintaining a slim OD.

The dual flapper isolation valve according to one or more embodiments of the present disclosure will be able to be actuated to the open and closed positions remotely via any suitable manner, such as hydraulic pressure lines, thus eliminating the need for intervention to actuate the flapper valves. In other embodiments, as further described below, the dual flapper isolation valve may be mechanically actuated using an intervention tool. In the event of a malfunction, the dual flapper isolation valve will fail as is according to one or more embodiments.

Embodiments of the present disclosure having the aforementioned features and advantages include at least two solutions, the operating principles of which are detailed below.

Solution #1—Fixed Flow Tube

FIGS. 1-4 are related to a dual flapper isolation valve having a fixed flow tube. According to this solution, the dual flapper isolation valve includes two opposite-facing, independently actuated, tubing isolation valve flapper ("TIVF") tools. On TIVF tools, the flow tube remains static, while one or both flapper sub-assemblies travel over the static flow tube in order to open one or both of the flappers.

Referring to FIG. 1, a schematic illustration of a dual flapper isolation valve 100 having a fixed flow tube 102*a*, 102*b* is shown according to one or more embodiments of the disclosure. As shown, the dual flapper isolation valve 100 includes an upper flapper sub-assembly 104*a* and a lower flapper sub-assembly 104*b*. Further, the fixed flow tube includes an upper flow tube 102*a* and a lower flow tube 102*b*. According to one or more embodiments, the upper and lower flapper sub-assemblies 104*a*, 104*b* are independent, unidirectional, and installed in an "O" configuration around the fixed flow tube 102*a*, 102*b*. In this way, the dual flapper isolation valve 100 design includes two mirrored flapper systems facing in opposite directions. According to one or more embodiments of the disclosure, the flapper technology provides an optimum OD/ID ratio. The upper and lower flapper sub-assemblies 104*a*, 104*b* may be curved, flat, or may assume any other shape in accordance with one or more embodiments of the disclosure.

Figure 2:
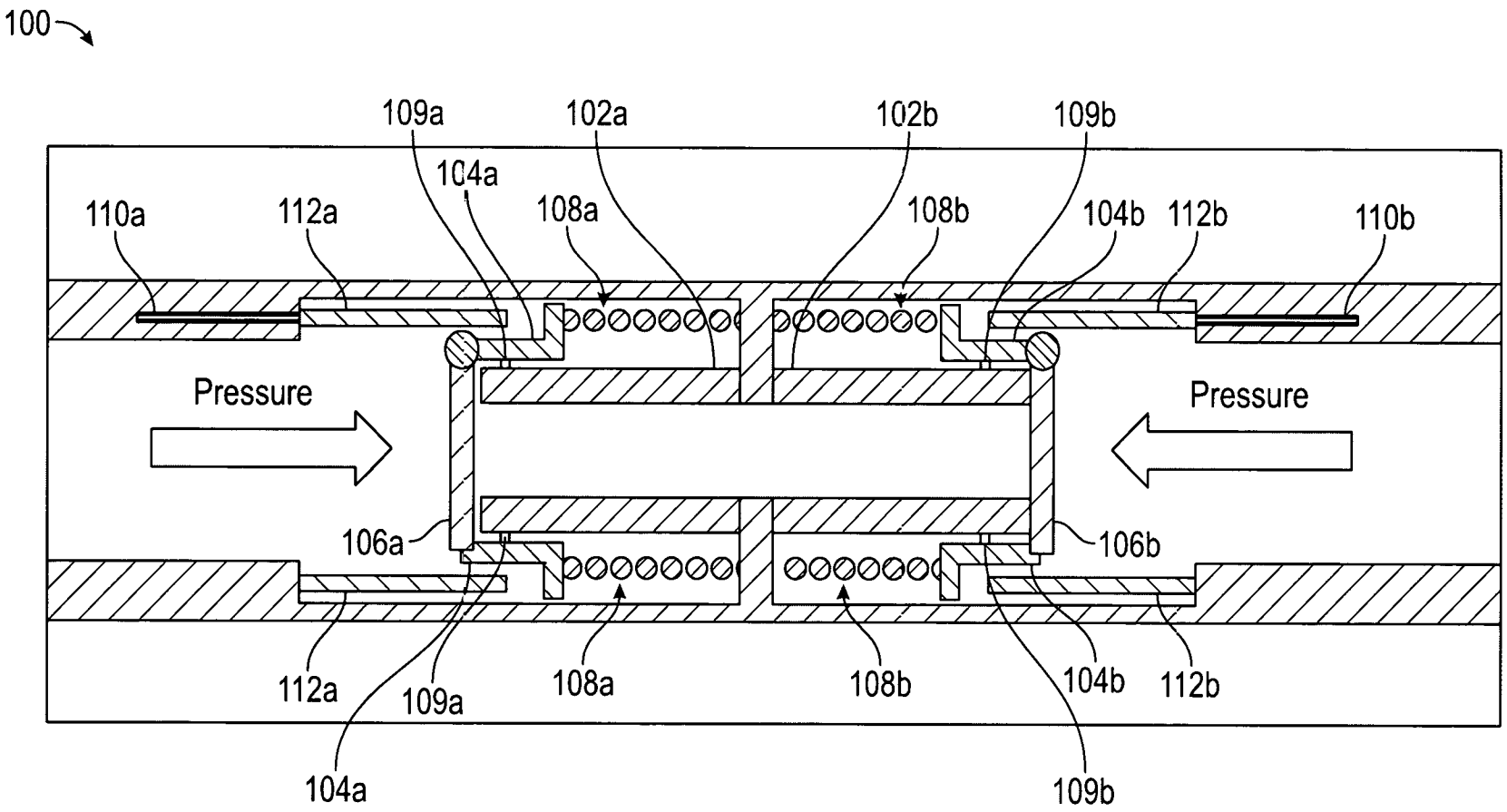
FIG. 2 is a schematic illustration of the dual flapper isolation valve of FIG. 1 holding pressure in the closed position according to one or more embodiments of the disclosure.

The upper flapper sub-assembly 104*a* includes an upper flapper 106*a*, and the lower flapper sub-assembly 104*b* includes a lower flapper 106*b*. According to one or more embodiments, the upper flapper 106*a* is a dart style, self-equalizing flapper sub-assembly, such as a sleeve on the side (part of 104, but not 106). That is, the upper flapper 106*a* is of a through flapper equalizing type design. As shown in FIG. 2, when in the closed position, the upper flapper 106*a* holds pressure from above, which may facilitate vertical Christmas tree pressure testing. Further, in one or more embodiments, the lower flapper 106*b* is of a non-equalizing design. As shown in FIG. 2, when in the closed position, the lower flapper 106*b* holds pressure from below to act as a well barrier and to hold reservoir pressure. In other embodiments, the upper flapper 106*a* may be of a non-equalizing design, the lower flapper 106*b* may be a self-equalizing flapper, both the upper flapper 106*a* and the lower flapper 106*b* may be self-equalizing flappers, or both the upper flapper 106*a* and the lower flapper 106*b* may be of the non-equalizing design.

Referring to FIGS. 1-2, the dual flapper isolation valve 100 includes an upper power spring 108*a* anchored to a body of the tool and connected to upper flapper sub-assembly 104*a*, and a lower power spring 108*b* anchored to the body of the tool and connected to the lower flapper sub-assembly 104*b*. According to one or more embodiments, the upper power spring 108*a* applies an upper force to the upper flapper sub-assembly 104*a* to maintain the upper flapper sub-assembly 104*a* in the closed position, and the lower power spring 108*b* applies a lower force to the lower flapper sub-assembly 104*b* to maintain the lower flapper sub-assembly 104*b* in the closed position. That is, with respect to the "O" configuration of the dual flapper isolation valve 100, the upper and lower flapper sub-assemblies 104*a*, 104*b* and the upper and lower flappers 106*a*, 106*b*, are normally closed instead of normally open.

Still referring to FIGS. 1-2, in one or more embodiments for example, the upper flapper sub-assembly 104*a* includes an upper locking mechanism 109*a* that engages the upper flow tube 102*a*, and that transfers an upper axial load applied by an upper pressure differential through the upper flow tube 102*a* onto the body of the tool when the upper flapper sub-assembly 104*a* is in the closed position. In one or more embodiments for example, the lower flapper sub-assembly 104*b* includes a lower locking mechanism 109*b* that engages the lower flow tube 102*b*, and that transfers a lower axial load applied by a lower pressure differential through the lower flow tube 102*b* onto the body of the tool when the lower flapper sub-assembly 104*b* is in the closed position. According to one or more embodiments, the upper and lower locking mechanisms 109*a*, 109*b* may be locking (or load) dogs as appreciated by those having ordinary skill in the art.

Referring to FIGS. 1-2, the dual flapper isolation valve 100 further includes an upper rod piston 110*a* that independently actuates the upper flapper sub-assembly 104*a* from the closed position to the open position. According to one or more embodiments, the upper rod piston 110*a* actuates the upper flapper sub-assembly 104*a* from the closed position to the open position via hydraulic pressure. The dual flapper isolation valve 100 also includes a lower rod piston 110*b* that independently actuates the lower flapper sub-assembly 104*b* from the closed position to the open position. According to one or more embodiments, the lower rod piston 110*b* actuates the lower flapper sub-assembly 104*b* via hydraulic pressure. That is, in one or more embodiments, the dual flapper isolation valve 100 requires at least two hydraulic control lines to operate each flapper sub-assembly 104*a*, 104*b* independently via the respective rod pistons 110*a*, 110*b*. In other embodiments of the design, however, both flapper sub-assemblies 104*a*, 104*b* may be tied to a single control line.

If no hydraulic pressure is applied to the rod pistons 110*a*, 110*b*, as shown in FIG. 2 for example, the upper and lower power springs 108*a*, 108*b* apply closing forces to maintain the upper and lower flapper sub-assemblies 104*a*, 104*b* in the closed position. As previously described, in the closed position, the flapper sub-assemblies 104*a*, 104*b* are provisioned with locking mechanisms 109*a*, 109*b*, which transfer the axial load being applied by the flapper pressure differential through the flow tubes 102*a*, 102*b* and onto the tool's main body components. In the event of an emergency, or if hydraulic integrity is lost, the dual flapper isolation valve 100 will fail closed.

Figure 3:
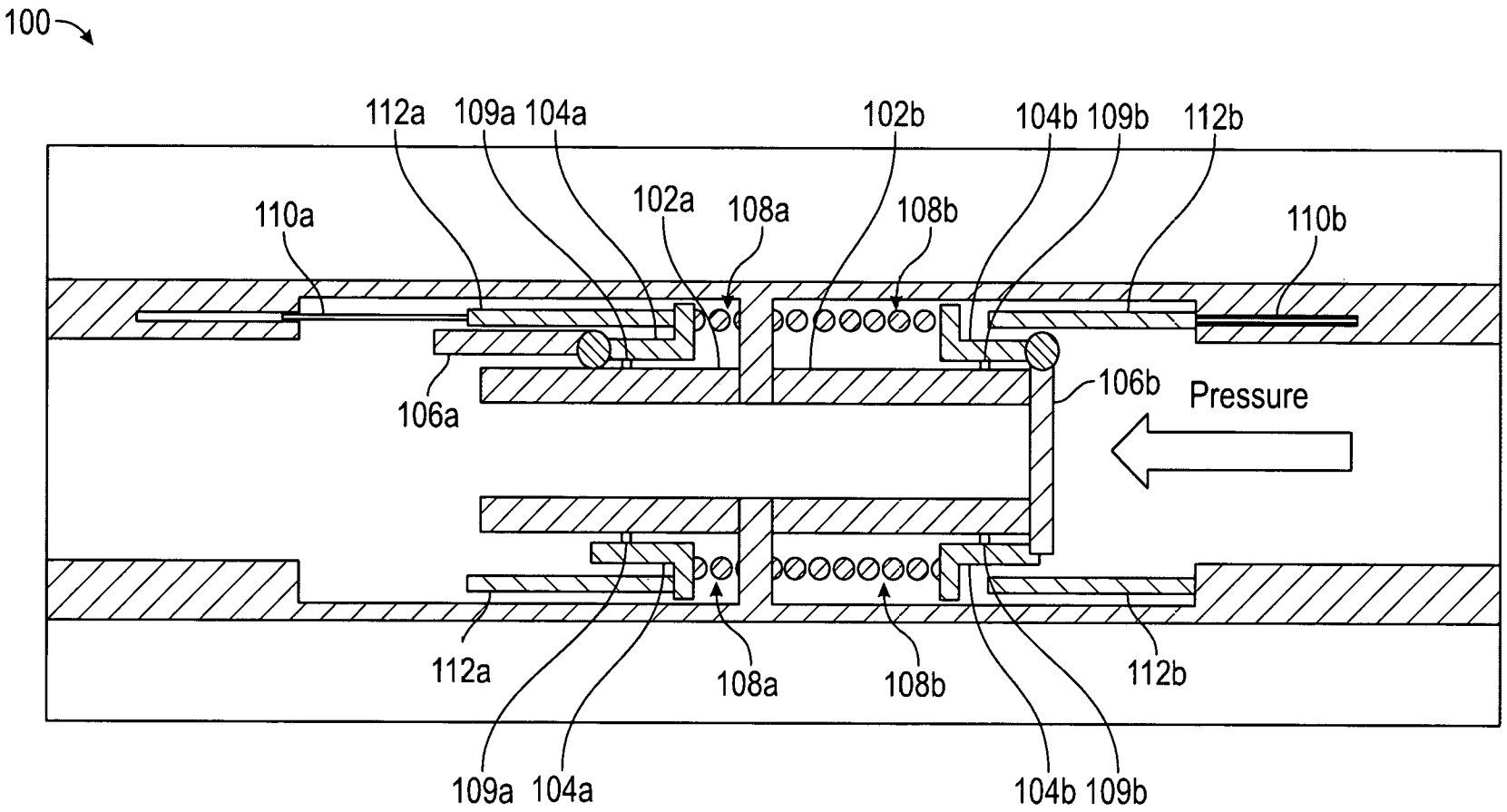
FIG. 3 is a schematic illustration of the dual flapper isolation valve of FIG. 2 with an upper flapper valve in an open position and a lower flapper valve in a closed position according to one or more embodiments of the disclosure.

Referring now to FIG. 3, a schematic illustration of the dual flapper isolation valve 100 with the upper flapper 106*a* in the open position according to one or more embodiments of the present disclosure is shown. As shown in FIG. 3, applying hydraulic pressure to the upper rod piston 110*a* overcomes the force and friction of the upper power spring 108*a*, as indicated by the compression of the upper power spring 108*a*. As hydraulic pressure is being applied, the upper rod piston 110*a* and the upper sleeve 112*a* of the dual flapper isolation valve 100 travel, engage the upper flapper sub-assembly 104*a*, and begin shifting the upper flapper sub-assembly 104*a* from the closed position to the open position. That is, the upper flow tube 102*a* remains stationary when the upper flapper sub-assembly 104*a* is actuated from the closed position to the open position. Alternatively, when hydraulic pressure is bled, the upper power spring 108*a* will push the upper flapper sub-assembly 104*a* to the closed position and the upper flapper 106*a* will hold pressure.

According to one or more embodiments, during the initial movement of the upper flapper sub-assembly 104*a* from the closed position to the open position, the upper flapper 106*a* engages the upper flow tube 102*a* and equalizes the upper pressure differential through the upper flow tube 102*a*, which removes the upper axial load from the upper flow tube 102*a*. That is, according to one or more embodiments, the dual flapper isolation valve 100 may include an equalizing mechanism to reduce the pressure differential across the upper flapper 106*a* prior to opening the upper flapper sub-assembly 104*a*. According to a through the flapper equalizing mechanism, the upper locking mechanism 109*a* (e.g., at least one load or locking dog) disengages from the upper flow tube 102*a* prior to equalization. More specifically, the through the flapper equalization mechanism works by the upper flow tube 102*a* engaging on a spring-loaded dart on the upper flapper 106*a*. When the dart is pushed off seat, the dart opens a pathway for pressure to equalize across it. After equalization through the upper flapper 106*a*, the upper flapper 106*a* of the upper flapper sub-assembly 104*a* may move from the closed position to the open position. This equalization mechanism, which reduces the pressure differential across the flapper prior to opening the flapper, is optional.

In another equalization mechanism according to one or more embodiments of the disclosure, a side equalizing device performs equalization by using a sleeve to shift a key that is initially engaged on one or more sealing elements, which may be O-rings, for example. During equalization according to this mechanism, the one or more sealing elements are disengaged to allow pressure to equalize across the upper flapper 106*a*. After equalization and disengagement of the one or more sealing elements, the upper locking mechanism 109*a* (e.g., at least one load or locking dog) is allowed to expand and disengage from the upper flow tube 102*a*, which allows the upper flapper sub-assembly 104*a* to move downwards, thereby causing the upper flapper 106*a* of the upper flapper sub-assembly 104*a* to move from the closed position to the open position. This equalization mechanism is also optional.

Further, as previously described, the lower flapper 106*b* of the lower flapper sub-assembly 104*b* may be a self-equalizing flapper according to one or more embodiments. In that case, the previously described equalization mechanisms may apply to the lower flapper 106*b* of the lower flapper sub-assembly 104*b*.

Figure 4:
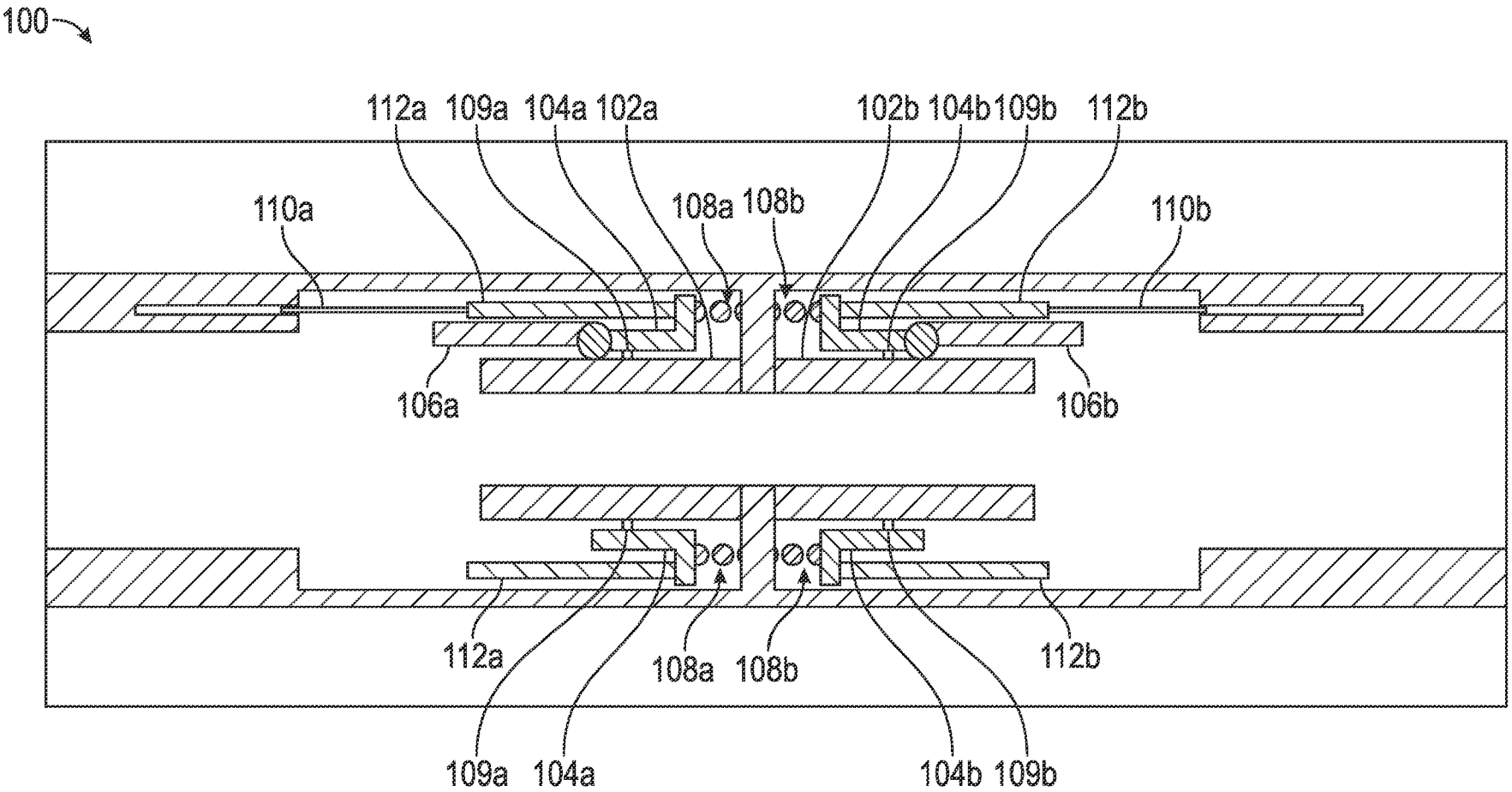
FIG. 4 is a schematic illustration of the dual flapper isolation valve of FIG. 3 with a lower flapper valve in an open position according to one or more embodiments of the disclosure.

Referring now to FIG. 4, a schematic illustration of the dual flapper isolation valve 100 with the lower flapper 106*b* in the open position according to one or more embodiments of the present disclosure is shown. As shown in FIG. 4, applying hydraulic pressure to the lower rod piston 110*b* overcomes the force and friction of the lower power spring 108*b*, as indicated by the compression of the lower power spring 108*b*. As hydraulic pressure is being applied, the lower rod piston 110*b* and the lower sleeve 112*a* of the dual flapper isolation valve 100 travel, engage the lower flapper sub-assembly 104*b*, and begin shifting the lower flapper sub-assembly 104*b* from the closed position to the open position. That is, the lower flow tube 102*b* remains stationary when the lower flapper sub-assembly 104*b* is actuated from the closed position to an open position. Alternatively, when hydraulic pressure is bled, the lower power spring 108*b* will push the lower flapper sub-assembly 104*b* to the closed position and the lower flapper 106*b* will hold pressure.

According to one or more embodiments of the disclosure, because the lower flapper 106*b* is a non-equalizing flapper, an operator applies pressure from above to equalize pressure across the lower flapper 106*b* prior to applying hydraulic pressure to the lower piston rod 110*b*. In one or more embodiments, equalization to reduce the pressure differential across the flapper prior to opening the flapper is optional. Further, as previously described, the upper flapper 106*a* of the upper flapper sub-assembly 104*a* may be a non-equalizing flapper according to one or more embodiments. In that case, the previously described application of pressure by an operator may apply to the upper flapper 106*a* of the upper flapper sub-assembly 104*a*.

Unless otherwise indicated, the detailed description in this section may apply to both the upper and the lower flapper systems. According to one or more embodiments, each flapper sub-assembly 104*a*, 104*b* is operated in an identical fashion and is controlled by a completely independent hydraulic pressure line.

According to one or more embodiments of the present disclosure, due to the independent actuation of the flapper sub-assemblies 104*a*, 104*b*, the flappers 106*a*, 106*b* of the upper and the lower flapper sub-assemblies 104*a*, 104*b* may be opened at the same time, the upper flapper 106*a* of the upper flapper sub-assembly 104*a* may open before the lower flapper 106*b* of the lower flapper sub-assembly 104*b*, or the lower flapper 106*b* of the lower flapper sub-assembly 104*b* may open before the upper flapper 106*a* of the upper flapper sub-assembly 104*a*.

Solution #2—Travelling Flowtube

Operating Principle

Figure 5:
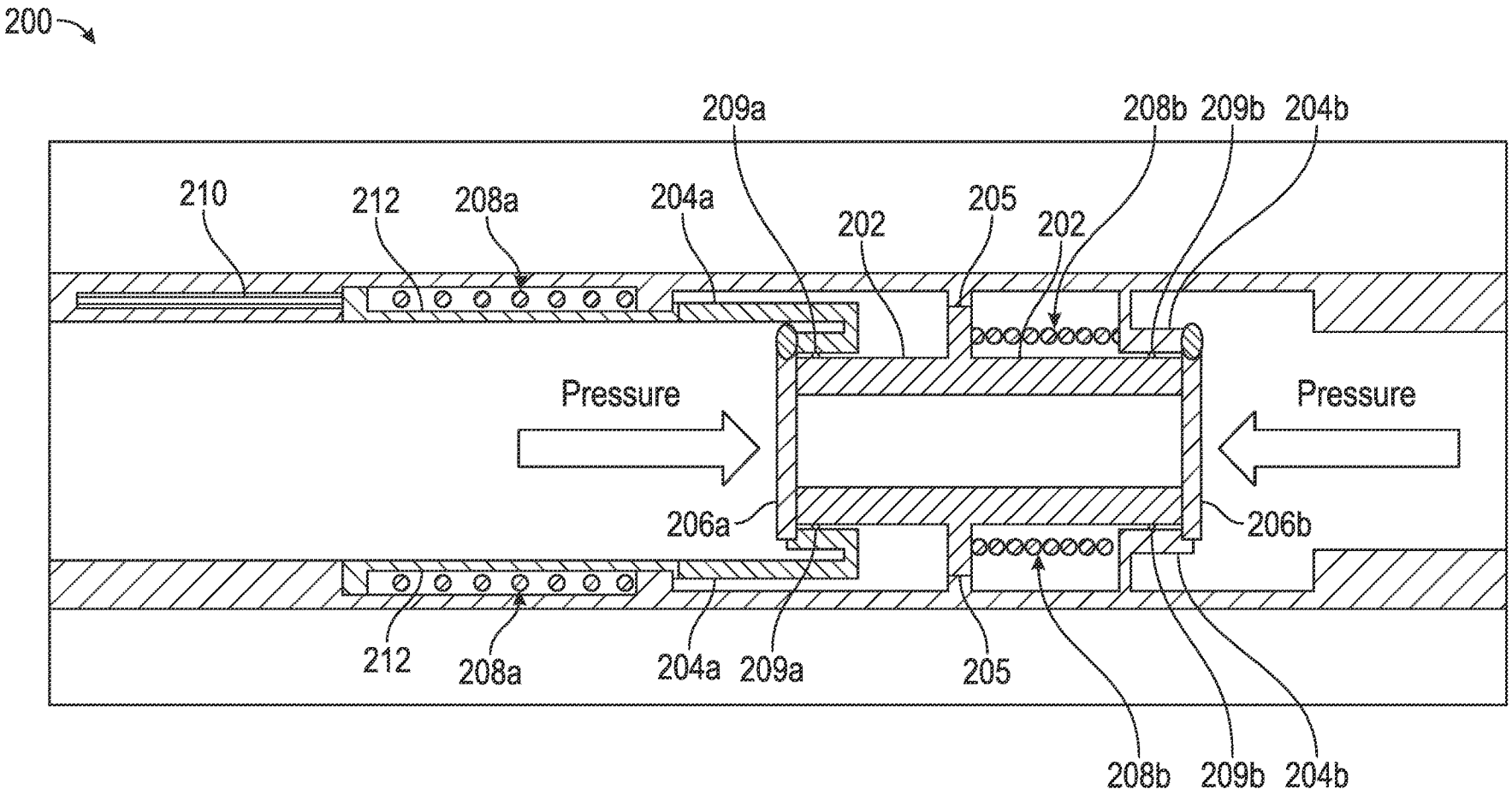
FIG. 5 is a schematic illustration of a dual flapper isolation valve having a travelling flow tube in a closed position according to one or more embodiments of the disclosure.
Figure 6:
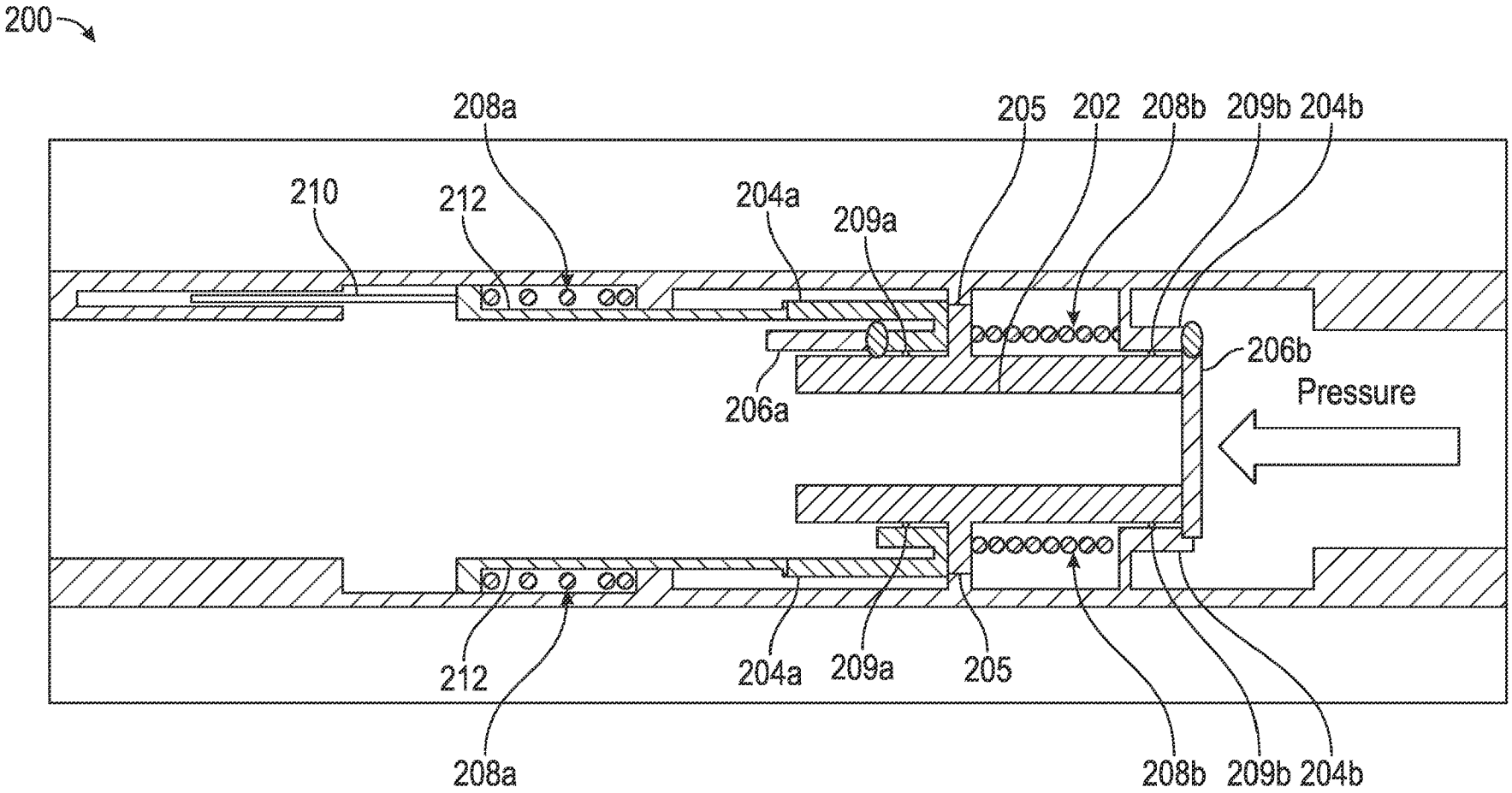
FIG. 6 is a schematic illustration the dual flapper isolation valve of FIG. 5 with an upper flapper valve in an open position and a lower flapper valve in a closed position according to one or more embodiments of the disclosure.
Figure 7:
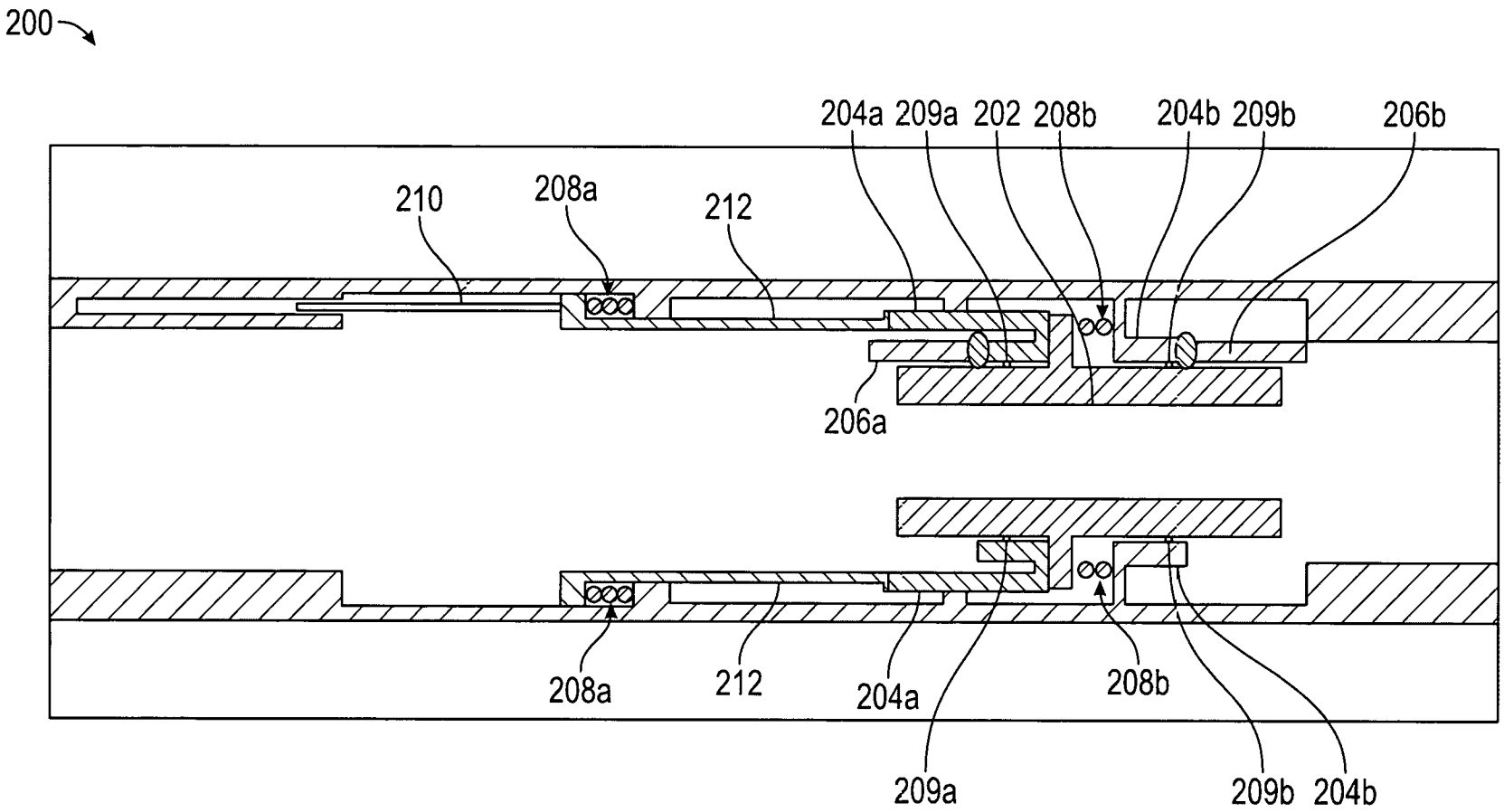
FIG. 7 is a schematic illustration of the dual flapper isolation valve of FIG. 6 with the upper and lower flapper valves in the open position according to one or more embodiments of the disclosure.

FIGS. 5-7 are related to a dual flapper isolation valve having a travelling flow tube. According to this solution, the dual flapper isolation valve includes two opposite-facing components. The top component operates as a hydraulically actuated TIVF tool, and the bottom component operates as a traditional safety valve. In this solution, the flow tube travels to open the lower flapper.

Referring to FIG. 5, a schematic illustration of a dual flapper isolation valve 200 having a travelling flow tube 202 is shown according to one or more embodiments of the disclosure. As shown, the dual flapper isolation valve 200 includes an upper flapper sub-assembly 204*a* and a lower flapper sub-assembly 204*b*. According to one or more embodiments, the upper and lower flapper sub-assemblies 204*a*, 204*b* are unidirectional, and installed in an "O" configuration around the flow tube 202. In this way, the dual flapper isolation valve 200 design includes two mirrored flapper systems facing in opposite directions. According to one or more embodiments of the disclosure, the flapper technology provides an optimum OD/ID ratio. The upper and lower flapper sub-assemblies 204*a*, 204*b* may be curved, flat, or may assume any other shape in accordance with one or more embodiments of the present disclosure.

The upper flapper sub-assembly 204*a* includes an upper flapper 206*a*, and the lower flapper sub-assembly 204*b* includes a lower flapper 206*b*. According to one or more embodiments, the upper flapper 206*a* is a dart style, self-equalizing flapper. That is, the upper flapper 206*a* is of a through flapper equalizing type design. As shown in FIG. 5, when in the closed position, the upper flapper 206*a* holds pressure from above, which may facilitate vertical Christmas tree pressure testing. Further, in one or more embodiments, the lower flapper 206*b* is of a non-equalizing design. As shown in FIG. 5, when in the closed position, the lower flapper 206*b* holds pressure from below to act as a well barrier and to hold reservoir pressure. In other embodiments, the upper flapper 206*a* may be of a non-equalizing design, the lower flapper 206*b* may be a self-equalizing flapper, both the upper flapper 206*a* and the lower flapper 206*b* may be self-equalizing flappers, or both the upper flapper 206*a* and the lower flapper 206*b* may be of the non-equalizing design.

According to one or more embodiments of the present disclosure, the flow tube 202 is temporarily fixed. That is, as further described below, one or more embodiments of the present disclosure may take the form of a flow tube 202 that is fixed until an upper flapper sub-assembly-204*a* reaches the open position. Then, the flow tube 202 and the upper flapper sub-assembly 204*a* travel together until a lower end of the flow tube 202 opens the lower flapper sub-assembly 204*b*, which is fixed to the body of the dual flapper isolation valve 200. The dual flapper isolation valve 200 may be actuated in any suitable manner, such as via hydraulic operation, for example. As also further described below, an opening force will move the upper flapper sub-assembly 204*a* over the flow tube 202 and then shift the flow tube 202 down to open the lower flapper 206*b* of the lower flapper sub-assembly 204*b*. A closing force (provided by hydraulic pressure or via a power spring) will push both the flow tube 202 and the upper flapper sub-assembly 206*a* to the closed position.

Still referring to FIG. 5, the dual flapper isolation valve 200 includes an upper power spring 208*a* connected to a shifting sleeve 212 within a body of the tool. Referring now to FIGS. 5-6, the dual flapper isolation valve 200 includes a lower power spring 208*b* anchored to the flow tube 202 and connected to the body of the tool. According to one or more embodiments, the upper power spring 208*a* pushes on the shifting sleeve 212 to maintain the upper flapper sub-assembly 204*a* in the closed position, and the lower power spring 208*b* pushes on the flow tube 202 to maintain the lower flapper sub-assembly 204*b* in the closed position. That is, with respect to the "O" configuration of the dual flapper isolation valve 200, the upper and lower flapper sub-assemblies 204*a*, 204*b* and the upper and lower flappers 206*a*, 206*b*, are normally closed instead of normally open.

Still referring to FIG. 5, in one or more embodiments for example, the upper flapper sub-assembly 204*a* includes an upper locking mechanism 209*a* that engages the flow tube 202, and that transfers an upper axial load applied by an upper pressure differential through the flow tube 202 to the flow tube 202. In one or more embodiments for example, the lower flapper sub-assembly 204*b* includes a lower locking mechanism 209*b* that engages the flow tube 202, and that transfers a lower axial load applied by a lower pressure differential through the flow tube 202 to the flow tube 202. Further, in one or more embodiments, for example, the flow tube 202 transfers the upper axial load and the lower axial load onto a body of the downhole tool via an intermediate locking mechanism 205 when the upper flapper sub-assembly 204*a* and the lower flapper sub-assembly 204*b* are in the closed position.

Referring now to FIG. 6, a schematic illustration of the dual flapper isolation valve 200 is shown with the upper flapper 206*a* in the open position and the lower flapper 206*b* in the closed position. As shown in FIG. 6, the dual flapper isolation valve 200 further includes a single rod piston 210 that actuates the upper flapper sub-assembly 204*a* from the closed position to the open position. According to one or more embodiments, the single rod piston 210 actuates the upper flapper sub-assembly 204*a* from the closed position to the open position via hydraulic pressure.

According to one or more embodiments, the single rod piston 210 has a stroke that is long enough to cycle open both the upper flapper sub-assembly 204*a* and the lower flapper sub-assembly 204*b*, as shown in FIG. 7, for example. That is, the single rod piston 210 may facilitate actuation of the lower flapper sub-assembly 204*b* from the closed position to the open position via sufficient or additional hydraulic pressure being applied to a single control line to be operated by the single rod piston 210.

If no hydraulic pressure is applied to the single rod piston 210, as shown in FIG. 5 for example, the upper power spring 208*a* applies a closing force to maintain both the upper flapper sub-assembly 204*a* and the lower flapper sub-assembly 204*b* in the closed position. As previously described, in the closed position, upper flapper sub-assembly 204*a* is provisioned with an upper locking mechanism 209*a*, which transfers the upper axial load applied by an upper pressure differential through the flow tube 202 to the flow tube 202. The flow tube 202 in turn transfers the load onto the tool's main body components via the intermediate locking mechanism 205. In the event of an emergency, or if hydraulic integrity is lost, the dual flapper isolation valve 200 will fail closed.

Referring back to FIG. 6, applying hydraulic pressure to the single rod piston 210 overcomes the force and friction of the upper power spring 208*a*, as indicated by the compression of the upper power spring 208*a*. As hydraulic pressure is being applied, the single rod piston 210 and the shifting sleeve 212 of the dual flapper isolation valve 200 travel, engage the upper flapper sub-assembly 204*a*, and begin shifting the upper flapper sub-assembly 204*a* from the closed position to the open position.

According to one or more embodiments, during the initial movement of the upper flapper sub-assembly 204*a* from the closed position to the open position, the upper flapper 206*a* engages the flow tube 202 and equalizes the upper pressure differential through the flow tube 202, which removes the upper axial load from the flow tube 202. That is, according to one or more embodiments, the dual flapper isolation valve 200 may include an equalizing mechanism to reduce the pressure differential across the upper flapper 206*a* prior to opening the upper flapper sub-assembly 204*a*. According to a through the flapper equalizing mechanism, the upper locking mechanism 209*a* (e.g., at least one load or locking dog) disengages from the flow tube 202 prior to equalization. More specifically, the through the flapper equalization mechanism works by the flow tube 202 engaging on a spring-loaded dart on the upper flapper 206*a*. When the dart is pushed off seat, the dart opens a pathway for pressure to equalize across it. After equalization through the upper flapper 206*a*, the upper flapper 206*a* of the upper flapper sub-assembly 204*a* may move from the closed position to the open position. This equalization mechanism, which reduces the pressure differential across the flapper prior to opening the flapper, is optional.

In another equalization mechanism according to one or more embodiments of the disclosure, a side equalizing device performs equalization by using a sleeve to shift a key that is initially engaged on one or more sealing elements, which may be O-rings, for example. During equalization according to this mechanism, the one or more sealing elements are disengaged to allow pressure to equalize across the upper flapper 206*a*. After equalization and disengagement of the one or more sealing elements, the upper locking mechanism 209*a* (e.g., at least one load or locking dog) is allowed to expand and disengage from the flow tube 202, which allows the upper flapper sub-assembly 204*a* to move downwards, thereby causing the upper flapper 206*a* of the upper flapper sub-assembly 204*a* to move from the closed position to the open position. This equalization mechanism is also optional.

Further, as previously described, the lower flapper 206*b* of the lower flapper sub-assembly 204*b* may be a self-equalizing flapper according to one or more embodiments. In that case, the previously described equalization mechanisms may apply to the lower flapper 206*b* of the lower flapper sub-assembly 204*b*.

Referring back to FIG. 7, a schematic illustration of the dual flapper isolation valve 200 with the upper and lower flappers 206*a*, 206*b* in the open position according to one or more embodiments of the present disclosure is shown. As shown in FIGS. 6-7, applying additional hydraulic pressure to the single rod piston 210 (or a single application of sufficient hydraulic pressure to the single rod piston 210) allows the intermediate locking mechanism 205 that holds the flow tube 202 engaged to the body of the tool to release after the upper flapper sub-assembly 204*a* reaches the open position. Release of the intermediate locking mechanism 205 allows the flow tube 202 to travel downward to engage the lower flapper 206*b* and open the lower flapper sub-assembly 204*b*. According to one or more embodiments of the disclosure, because the lower flapper 206*b* is a non-equalizing flapper, an operator applies pressure from above to equalize pressure across the lower flapper 206*b* prior to applying hydraulic opening pressure to the single rod piston 210. In one or more embodiments, equalization to reduce the pressure differential across the flapper prior to opening the flapper is optional. Further, as previously described, the upper flapper 206*a* of the upper flapper sub-assembly 204*a* may be a non-equalizing flapper according to one or more embodiments. In that case, the previously described application of pressure by an operator may apply to the upper flapper 206*a* of the upper flapper sub-assembly 204*a*.

In view of FIGS. 5-7, in order to close the lower flapper 206*b* of the dual flapper isolation valve 200, the shifting sleeve 212 is pushed up-hole via the close hydraulic line or via a power spring. A dog release collet, which is inside the upper flapper sub-assembly 204*a*, engages on the flow tube 202 with enough force to pull it in the up-hole direction until the flow tube 202 shoulders on the housing of the flow tube 202. Thereafter, the lower flapper 206*b* of the lower flapper sub-assembly 204*b* moves from the open position to the closed position, and the intermediate locking mechanism 205 is engaged. Then, the closing force on the shifting sleeve 212 overcomes the collet force and causes the dog release collet inside the upper flapper sub-assembly 204*a* to release the flow tube 202. The shifting sleeve 212 then shoulders on the upper flapper sub-assembly 204*a* and pulls it up to the closed position until the upper flapper 206*a* closes and the upper locking mechanism 209*a* re-engages the flow tube 202.

According to one or more embodiments of the disclosure, the fixed flow tube and the travelling flow tube solutions both implement an OD/ID ratio efficient closure mechanism, a pressure equalizing method device, pressure containing body connections, and a remotely activated actuation system.

As previously described, the fixed flow tube and the travelling flow tube solutions of one or more embodiments of the disclosure may implement a rod piston actuation method as a simple and effective means of hydraulic actuation. Rod pistons have a relatively small hydraulic area, and as such, require relatively low compression spring forces to overcome hydrostatic pressures. Alternatively, in some embodiments, one or more concentric pistons may be used instead of one or more rod pistons. Concentric pistons have comparatively larger hydraulic areas than rod pistons, allowing higher opening forces at the expense of requiring higher compression spring forces to overcome hydrostatic pressure. According to other embodiments, other actuation mechanisms may be employed in addition to the hydraulic actuation mechanisms of the rod piston and the concentric piston such as actuation via a shifting sleeve, electrical actuation, or mechanical actuation using an intervention tool such as a mechanical actuation device.

In applications where elastomers cannot be used, in one or more embodiments of the disclosure, non-elastomeric, metal spring energized (MSE) seals may be used as a reliable alternative. For applications that are compatible with elastomers, both rod and concentric piston seals may be used in one or more embodiments.

In one or more embodiments, the tool subject of this disclosure may be designed as a fail-open, fail-closed, or fail-as-is. Fail-open and fail-closed may be achieved by changing the configuration and orientation of the compression springs and/or the hydraulic operating system. According to one or more embodiments, fail-as-is may be achieved by removing the power spring or utilizing a ratchet, collet, or other mechanism that will oppose the force of the power spring, leaving the flapper sub-assembly in its current position in the event that communication to the valve is lost.

In one or more embodiments, the dual flapper isolation valve of either solution may be provisioned with the ability to mechanically shift the valve to the open/closed position. Moreover, in one or more embodiments, the dual flapper isolation valve of either solution may be able to be permanently locked open in the event that remote communication to the valve is lost.

The foregoing description outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure.

The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A downhole tool comprising:

an upper flow tube connected to a lower flow tube;

an upper flapper sub-assembly comprising an upper flapper; and a lower flapper sub-assembly comprising a lower flapper, wherein the upper flapper sub-assembly and the lower flapper sub-assembly are installed with respect to the upper flow tube and the lower flow tube such that the upper flapper sub-assembly and the lower flapper sub-assembly are in a closed position, wherein the upper flapper sub-assembly and the lower flapper sub-assembly are capable of being independently actuated, and wherein the upper flow tube and the lower flow tube remain stationary when the upper flapper sub-assembly or the lower flapper sub-assembly is actuated from the closed position to an open position.

2. The downhole tool of claim 1, wherein the upper flapper holds pressure from above when the upper flapper sub-assembly is in the closed position, and wherein the lower flapper holds pressure from below when the lower flapper sub-assembly is in the closed position.

3. The downhole tool of claim 1, wherein the upper flapper is a self-equalizing flapper.

4. The downhole tool of claim 3, wherein the lower flapper is a non-equalizing flapper.

5. The downhole tool of claim 1, further comprising:

an upper power spring that applies an upper force to the upper flapper sub-assembly to maintain the upper flapper sub-assembly in the closed position; and a lower power spring that applies a lower force to the lower flapper sub-assembly to maintain the lower flapper sub-assembly in the closed position.

6. The downhole tool of claim 5, wherein the upper flapper sub-assembly comprises an upper locking mechanism that engages the upper flow tube, and that transfers an upper axial load applied by an upper pressure differential through the upper flow tube onto a body of the downhole tool when the upper flapper sub-assembly is in the closed position, and wherein the lower flapper sub-assembly comprises a lower locking mechanism that engages the lower flow tube, and that transfers a lower axial load applied by a lower pressure differential through the lower flow tube onto the body of the downhole tool when the lower flapper sub-assembly is in the closed position.

7. The downhole tool of claim 6, wherein the upper flapper equalizes the upper pressure differential through the upper flow tube, which removes the upper axial load as the upper flapper sub-assembly is actuated from the closed position to the open position, and wherein the upper locking mechanism disengages from the upper flow tube prior to equalization by the upper flapper.

8. The downhole tool of claim 5, further comprising:

an upper actuation mechanism that independently actuates the upper flapper sub-assembly from the closed position to the open position; and a lower actuation mechanism that independently actuates the lower flapper sub-assembly from the closed position to the open position.

9. The downhole tool of claim 8, wherein the upper actuation mechanism and the lower actuation mechanism actuate the upper flapper sub-assembly and the lower flapper sub-assembly via hydraulic pressure.

10. A method of operating a downhole tool, comprising:

installing an upper flapper sub-assembly comprising an upper flapper and a lower flapper sub-assembly comprising a lower flapper with respect to an upper flow tube and a lower flow tube such that the upper flapper sub-assembly and the lower flapper sub-assembly are in a closed position, wherein the upper flapper sub-assembly comprises an upper locking mechanism that engages the upper flow tube, and wherein the lower flapper sub-assembly comprises a lower locking mechanism that engages the lower flow tube;

independently actuating the upper flapper sub-assembly from the closed position to an open position; and independently actuating the lower flapper sub-assembly from the closed position to the open position, wherein the upper flow tube and the lower flow tube remain stationary when the upper flapper sub-assembly or the lower flapper sub-assembly is actuated from the closed position to the open position.

11. The method of claim 10, wherein the upper flapper holds pressure from above when the upper flapper sub-assembly is in the closed position, and wherein the lower flapper holds pressure from below when the lower flapper sub-assembly is in the closed position.

12. The method of claim 10, wherein the upper flapper is a self-equalizing flapper.

13. The method of claim 12, wherein the lower flapper is a non-equalizing flapper.

14. The method of claim 10, further comprising:

applying an upper force to the upper flapper sub-assembly to maintain the upper flapper sub-assembly in the closed position; and applying a lower force to the lower flapper sub-assembly to maintain the lower flapper sub-assembly in the closed position.

15. The method of claim 14, further comprising:

transferring an upper axial load applied by an upper pressure differential through the upper flow tube onto a body of the downhole tool when the upper flapper sub-assembly is in the closed position; and transferring a lower axial load applied by a lower pressure differential through the lower flow tube onto the body of the downhole tool when the lower flapper sub-assembly is in the closed position.

16. The method of claim 15, further comprising:

disengaging the upper locking mechanism from the upper flow tube; and equalizing the upper pressure differential through the upper flow tube, which removes the upper axial load as the upper flapper sub-assembly is actuated from the closed position to the open position.

17. The method of claim 16, further comprising:

equalizing the lower pressure differential across the lower flapper by applying pressure from above the lower flapper before independently actuating the lower flapper sub-assembly from the closed position to the open position.

18. The method of claim 14, wherein the upper flapper sub-assembly and the lower flapper sub-assembly are independently actuated via hydraulic pressure.

19. A downhole tool comprising:

a flow tube;

an upper flapper sub-assembly comprising an upper flapper;

a lower flapper sub-assembly comprising a lower flapper, wherein the upper flapper sub-assembly and the lower flapper sub-assembly are installed with respect to the flow tube such that the upper flapper sub-assembly and the lower flapper sub-assembly are in a closed position, wherein the upper flapper sub-assembly and the lower flapper sub-assembly are capable of being actuated from the closed position to an open position by a single actuation mechanism, and wherein, after the upper flapper sub-assembly is actuated from the closed position to the open position, the flow tube travels downward to engage the lower flapper and open the lower flapper sub-assembly.

20. The downhole tool of claim 19, wherein the upper flapper holds pressure from above when the upper flapper sub-assembly is in the closed position, and wherein the lower flapper holds pressure from below when the lower flapper sub-assembly is in the closed position.

21. The downhole tool of claim 19, wherein the upper flapper is a self-equalizing flapper.

22. The downhole tool of claim 21, wherein the lower flapper is a non-equalizing flapper.

23. The downhole tool of claim 19, further comprising:

an upper power spring that pushes on a shifting sleeve to maintain the upper flapper sub-assembly in the closed position; and a lower power spring that pushes on the flow tube to maintain the lower flapper sub-assembly in the closed position.

24. The downhole tool of claim 23, wherein the upper flapper sub-assembly comprises an upper locking mechanism that engages the flow tube, and that transfers an upper axial load applied by an upper pressure differential through the flow tube to the flow tube, wherein the lower flapper sub-assembly comprises a lower locking mechanism that engages the flow tube, and that transfers a lower axial load applied by a lower pressure differential through the flow tube to the flow tube, and wherein the flow tube transfers the upper axial load and the lower axial load onto a body of the downhole tool via an intermediate locking mechanism when the upper flapper sub-assembly and the lower flapper sub-assembly are in the closed position.

25. The downhole tool of claim 24, wherein, after the upper flapper sub-assembly is actuated from the closed position to the open position, the intermediate locking mechanism releases, which allows the flow tube to travel downward to engage the lower flapper and open the lower flapper sub-assembly.

26. The downhole tool of claim 25, wherein the upper flapper equalizes the upper pressure differential through the flow tube, which removes the upper axial load as the upper flapper sub-assembly is actuated from the closed position to the open position, and wherein the upper locking mechanism disengages from the flow tube prior to equalization by the upper flapper.

27. The downhole tool of claim 23, wherein the single actuation mechanism actuates the upper flapper sub-assembly and the lower flapper sub-assembly via hydraulic pressure.

28. A method of operating a downhole tool, comprising:

installing an upper flapper sub-assembly comprising an upper flapper and a lower flapper sub-assembly comprising a lower flapper with respect to a flow tube such that the upper flapper sub-assembly and the lower flapper sub-assembly are in a closed position, wherein the upper flapper holds pressure from above when the upper flapper sub-assembly is in the closed position, wherein the lower flapper holds pressure from below when the lower flapper sub-assembly is in the closed position, and wherein the upper flapper is a self-equalizing flapper;

actuating the upper flapper sub-assembly from the closed position to an open position by an actuation mechanism; and after the actuating the upper flapper sub-assembly step, opening the lower flapper sub-assembly by the flow tube travelling downward to engage the lower flapper.

29. The method of claim 28, wherein the lower flapper is a non-equalizing flapper.

30. The method of claim 28, further comprising:

transferring an upper axial load applied by an upper pressure differential through the flow tube to the flow tube; and transferring a lower axial load applied by a lower pressure differential through the flow tube to a body of the downhole tool; and transferring the upper axial load onto the body of the downhole tool via an intermediate locking mechanism when the upper flapper sub-assembly is in the closed position.

31. The method of claim 30, further comprising:

applying hydraulic pressure to the actuation mechanism to actuate the upper flapper sub-assembly from the closed position to the open position;

disengaging an upper locking mechanism from the flow tube;

equalizing the upper pressure differential through the flow tube, which removes the upper axial load from the flow tube as the upper flapper sub-assembly is actuated from the closed position to the open position; and after the upper flapper sub-assembly reaches the open position, using hydraulic pressure in the actuation mechanism to release the intermediate locking mechanism, which allows the flow tube to travel downward and engage the lower flapper.

32. The method of claim 31, further comprising:

equalizing the lower pressure differential across the lower flapper by applying pressure from above the lower flapper; and actuating the lower flapper sub-assembly from the closed position to the open position by the travelling flow tube.

* * * * *